US006508042B1

(12) United States Patent
Kweon et al.

(10) Patent No.: US 6,508,042 B1
(45) Date of Patent: Jan. 21, 2003

(54) MIDDLE ARMOR BLOCK FOR A COASTAL STRUCTURE AND A METHOD FOR PLACEMENT OF ITS BLOCK

(76) Inventors: Hyuck-Min Kweon, 1426-11, Sa-dang, Ansansi, Kyonggi-do (KR); Dal-Soo Lee, Yojin Apt., 203-1402, Sa-2 dong, Ansansi, Kyonggi-do (KR)

( * ) Notice: Subject to any disclaimer, the term of this patent is extended or adjusted under 35 U.S.C. 154(b) by 0 days.

(21) Appl. No.: 09/787,200

(22) PCT Filed: Sep. 18, 1999

(86) PCT No.: PCT/KR99/00565

§ 371 (c)(1),
(2), (4) Date: Mar. 15, 2001

(87) PCT Pub. No.: WO00/17453

PCT Pub. Date: Mar. 30, 2000

(30) Foreign Application Priority Data

Sep. 18, 1998 (KR) ..... 98-38696

(51) Int. Cl.[7] ..... E02B 3/04

(52) U.S. Cl. ..... 52/608; 52/574; 52/604; 52/606; 52/745.09; 52/747.12; 405/16; 405/29

(58) Field of Search ..... 52/574, 596, 603, 52/604, 606, 608, 745.09, 747.12; 405/15, 16, 29, 114, 284, 286

(56) References Cited

U.S. PATENT DOCUMENTS 2,577,170 A * 12/1951 Walters ..... 52/606 X
2,833,532 A * 5/1958 Ries ..... 52/604 X
3,176,468 A * 4/1965 Nagai et al. ..... 405/29
5,087,150 A * 2/1992 McCreary ..... 405/31
5,906,456 A * 5/1999 Knight ..... 405/20
5,921,710 A * 7/1999 Scales ..... 405/20
6,071,041 A * 6/2000 Knight ..... 405/16
6,276,870 B1 * 8/2001 Smith ..... 405/17

FOREIGN PATENT DOCUMENTS

JP 60-148909 8/1985

* cited by examiner

*Primary Examiner*—Carl D. Friedman
*Assistant Examiner*—Brian E. Glessner
(74) *Attorney, Agent, or Firm*—Foley & Lardner

(57) ABSTRACT

This invention relates to a middle armor block for a coastal structure and a method of placement of its block with a hydraulic stability of a slope surface and an economical construction cost. The middle armor block of the half-loc comprises a body forming an octagon column with a rectangle side and a perforated hole at the center, a leg integrally formed and attached to alternatively each side of the body and a protruding foot at a lower portion of the leg and each corner of the leg and the foot is chamfered. For a placement type of the blocks, the middle armor block of the half-loc are tilted with a certain angle and each side portion of the leg of the block is contacted to the other side portion of the leg of neighbor block all around directions in series.

12 Claims, 8 Drawing Sheets

MIDDLE ARMOR BLOCK FOR A COASTAL STRUCTURE AND A METHOD FOR PLACEMENT OF ITS BLOCK

CORRESPONDING RELATED APPLICATIONS

This application is a U.S. National Phase of PCT/KR99/00565 filed on Sep. 18, 1999, claiming priority to Korean Application No. 1998/38696 filed on Sep. 18, 1998.

BACKGROUND OF THE INVENTION

The present invention generally relates to a coastal structure and a method of its placement. More particularly, the present invention relates to a middle armor block for a coastal structure and a method of placement of its block with a hydraulic stability of a slope surface and an economical construction cost.

Generally, the coastal structure, which is located inside harbor or leeward, is installed underwater for protecting facility structures from transportation of wave energy. When the coastal structure is constructed for a breakwater or seawall, a sandy rock is used at an under layer of the coastal structure for hydraulically stabilizing on the slope surface, and artificial armor units are used at an upper layer of the coastal structure, such as a tetrapod, a dolos, an accropode or a core-loc for dissipating wave energy. Specifically, for a design method of the breakwater, a rubble mound breaker is widely adopted to install the artificial armor units for the front slope surface. Recently, Caisson adopted a composite type structure for constructing the breakwater.

Due to the increasing amount of trades and the size of surface freighters, there is a tendency to construct the breakwater on the deeper water advanced from the coast. Therefore, the weight of coating materials is expected to increase for protecting the structure against bigger waves. For the design of newly developing harbors, the severer weather and the bigger waves should be considered in comparison to the design conditions of a conventional harbor.

For protecting the important facilities on the leeward, the breakwater or seawall should be designed with at least a 100 year return period.

According to the conventional standard design method for a section, in case of constructing a large sized harbor, or a conventional rubble mound breakwater and the seawall, a weight ratio of an upper layer of coating materials and a lower layer of sandy stones would be 1:1/10. (Coastal Engineering Research Center, U.S. Army Corps of Engineers, 1984, Shore Protection Manual Pg. 7–228). It is possible to provide a demanded weight of the coating materials because the coating materials could be possibly manufactured by an artificial casting. But, it is not easy to provide enough amount of corresponding weight of the under layer of sandy stones because the natural rocks for under layer of sandy stones are usually provided nearby the construction site.

To solve the problems described above, a conventional artificial armor block or a slightly modified type of block is used instead of the lower layer of sandy rocks for the front slope layer coated block. In this case, it would not clearly be stable for the hydraulic characteristics of the whole section if the lower layer were exposed during a construction or placed together with the front slope layer coated block.

On the other hand, the Grovel sea level is raised because of the Laninor phenomenon. As a result, it may not be occurred the expected dissipation of wave energy due to wave breaking in the shallow water zone. However, the current design for the coastal structure does not consider the raised sea level.

SUMMARY OF THE INVENTION

An object of this invention is to overcome the problems described above and provide an artificial block (hereinafter "half-loc" to replace the sandy stones.

Another object of this invention is to provide a new form of the middle armor block for improving the ability of construction at the construction site and the stability of the breakwater.

Another object of this invention is to provide a safety placement method when a middle armor block is constructed along with the front slope layer coating material.

In order to accomplish the above objectives of this invention, the new form of the middle armor block comprises a body having a shape of octagon column with a rectangle side and a perforated hole at the center of the top of the body.

Four legs are integrally formed at each of a lower portion of the legs and each corner of the legs and the foot is chamfered.

The other objects and features of this invention will be in part apparent and in part pointed out hereinafter.

The detailed description of this invention will be described in reference to the aforementioned Figures.

DETAILED DESCRIPTION OF THE PREFERRED EMBODIMENTS

Figure 1A:
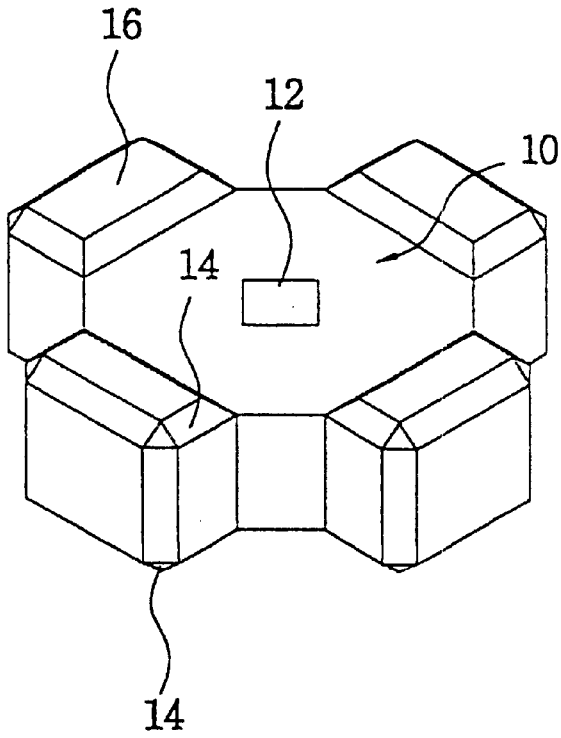
FIGS. 1A and 1B show a half-loc of embodiments of this invention.
Figure 1B:
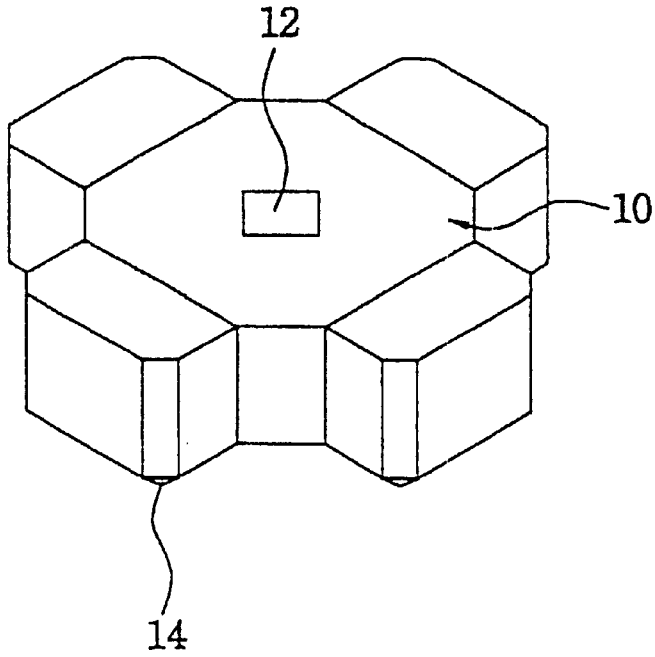

A middle armor block of a half-loc (hereinafter "half-loc" according to an embodiment of this invention is shown in FIGS. 1A and 1B. The half-loc mainly comprises a body 10 and a leg 14. The body 10 is formed in the shape of an octagon column with a rectangle side and a perforated hole 12 at the center of the top surface. The perforated hole 12 has a rectangular shape, preferably square. Four legs 14 are integrally formed and attached alternatively to the side of the body 10.

Also, a protruding foot 16 is formed at a lower portion and/or upper portion of the leg 14. The protruding foot 16 is disposed in an upward or downward direction at each of the top and bottom of the legs. Each corner of the lower portion and upper portion of the leg 16 and the foot 14 is chamfered.

The perforated hole 12 at the center of the body 10 is designed to pass the water upward or downward to disperse an up-lifting force. The perforated hole 12 has a square shape. Each side of the perforated hole 12 is parallel to the side of the body, which does not have a leg. The perforated hole 12 is disposed at the center of the top of the body in order to avoid the concentration of the stress. Each foot 16 formed on the top and bottom of the leg 14 will be locked in the upper and lower coated layer rocks of the breakwater or seawall and minimize the slippage. Therefore, it will improve the reinforcement of upper and lower coated layer rocks and increase the stability of the hydraulic characteristics. Also, the corners of the leg 14 are chamfered to disturb the water flows over the blocks.

Figure 2:
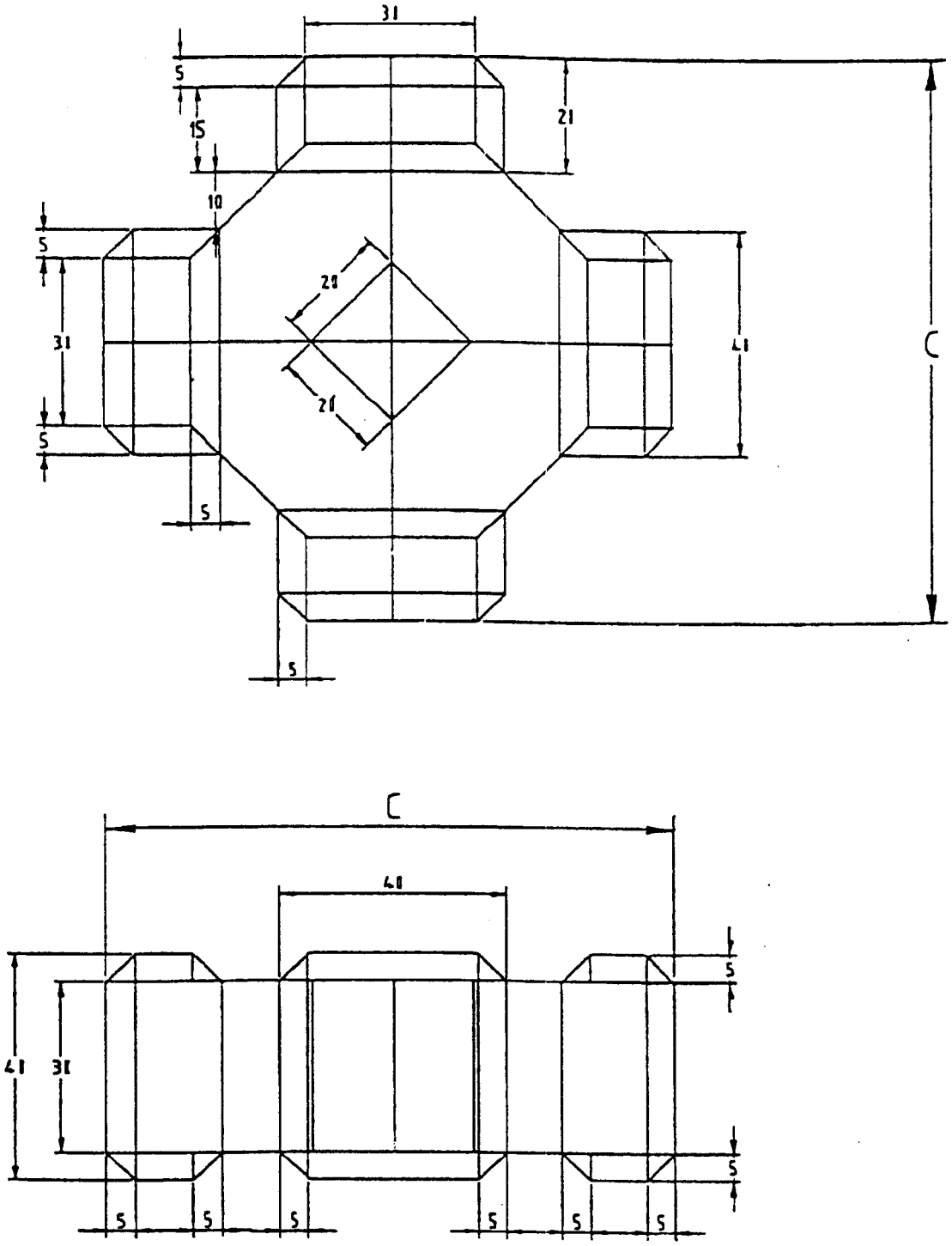
FIG. 2 shows a top view and a front view of the half-loc of one embodiment of the invention shown in FIG. 1A.

The detailed dimensions of the half-loc of an embodiment as shown in FIG. 1A are shown in FIG. 2.

The maximum length of the half-loc is shown in FIG. 2, i.e., a dimension C measured from an outside of the leg 14 to the opposite side of the leg 14, with an assumed scale of 100. It is favorable for the half-loc to have a thickness of the leg 14 approximately 20, a width of the leg 14 approximately 40, a thickness of the body 10 approximately 30 for the desirable stability and ability of the construction. Also, it is desirable for one side length of the perforated hole 12 to be approximately 20, and the height of the protruding portion of the foot 16 from the body 10 to be approximately 5. (Hereinafter the block having above dimension is called "block I".

For a convenient construction of the block, as an alternative embodiment of a half-loc without a top foot as shown in FIG. 1B, a modified form of the half-loc is considered to remove the upper extruding foot 16 of the leg 14 during the casting of the block. (Hereinafter the block without the upper foot is called "block 11".

The volumes of these blocks using the scale "C" for a standard dimension are representing:

$$V=0.2134\times C^3(\text{Block I})$$

$$V=0.19145\times C^3(\text{Block II}) \quad (1)$$

The important factor of construction of the half-loc is a placement type. The placement type is closely related to the stability of the block and dominantly related to a degree of interlocking and a porosity of the half-loc.

The placement type of FIG. 4 (hereinafter "Type II") shows another arrangement method where the chamfered portions of the legs of the blocks are contacted to the chamfered portions of the legs of the neighbor blocks all around the blocks in the series. The blocks of type II are disposed individually without a linked relationship to each other, and have a high porosity.

The placement type of FIG. 5 (hereinafter "Type III") discloses another arrangement method where the side portions of the legs of the block are tilted and contacted to the side portions of the legs of the neighbor blocks in the series.

Figure 3:
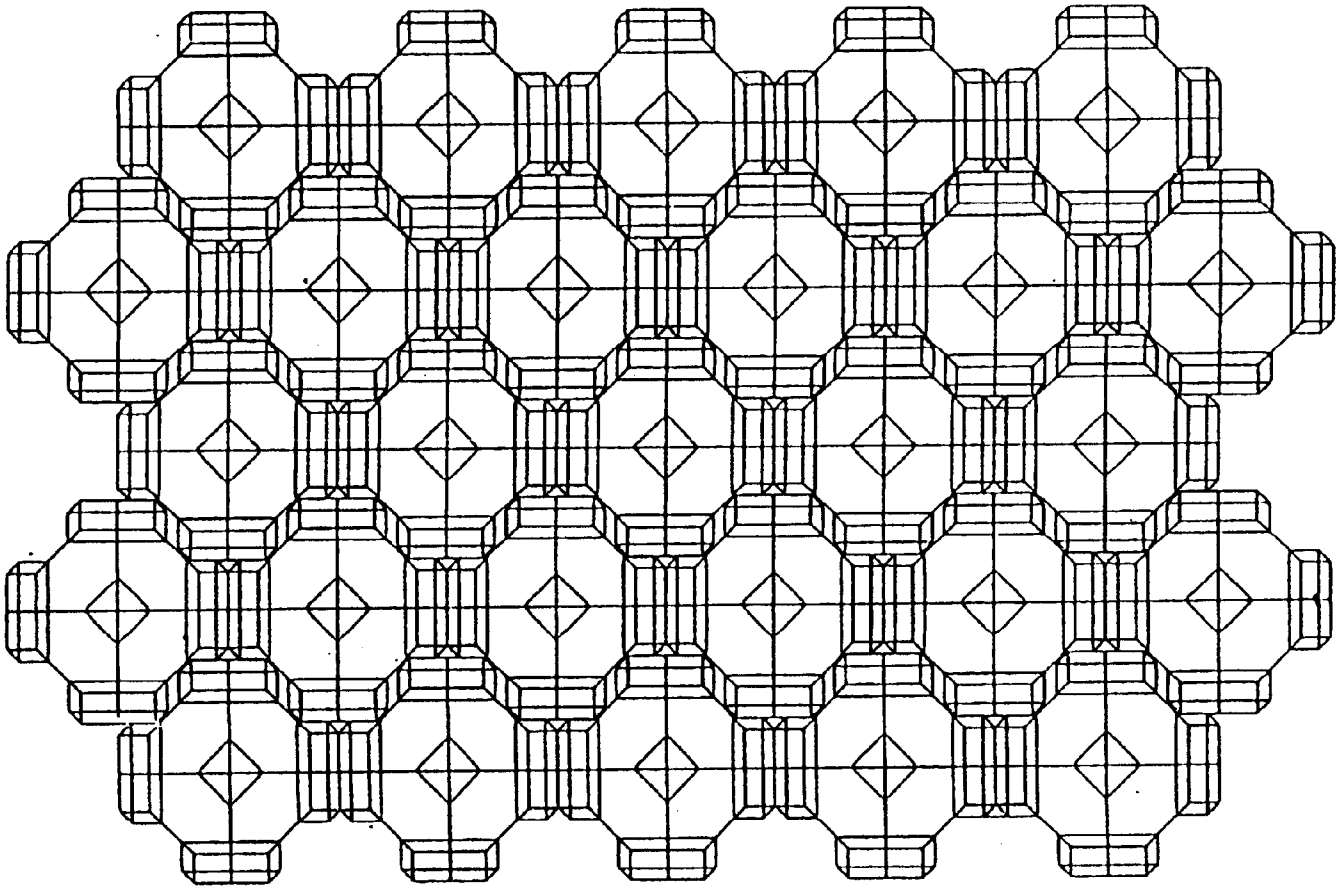
FIGS. 3 to 5 show a method of placement of the half-loc of an embodiment of this invention.
Figure 4:
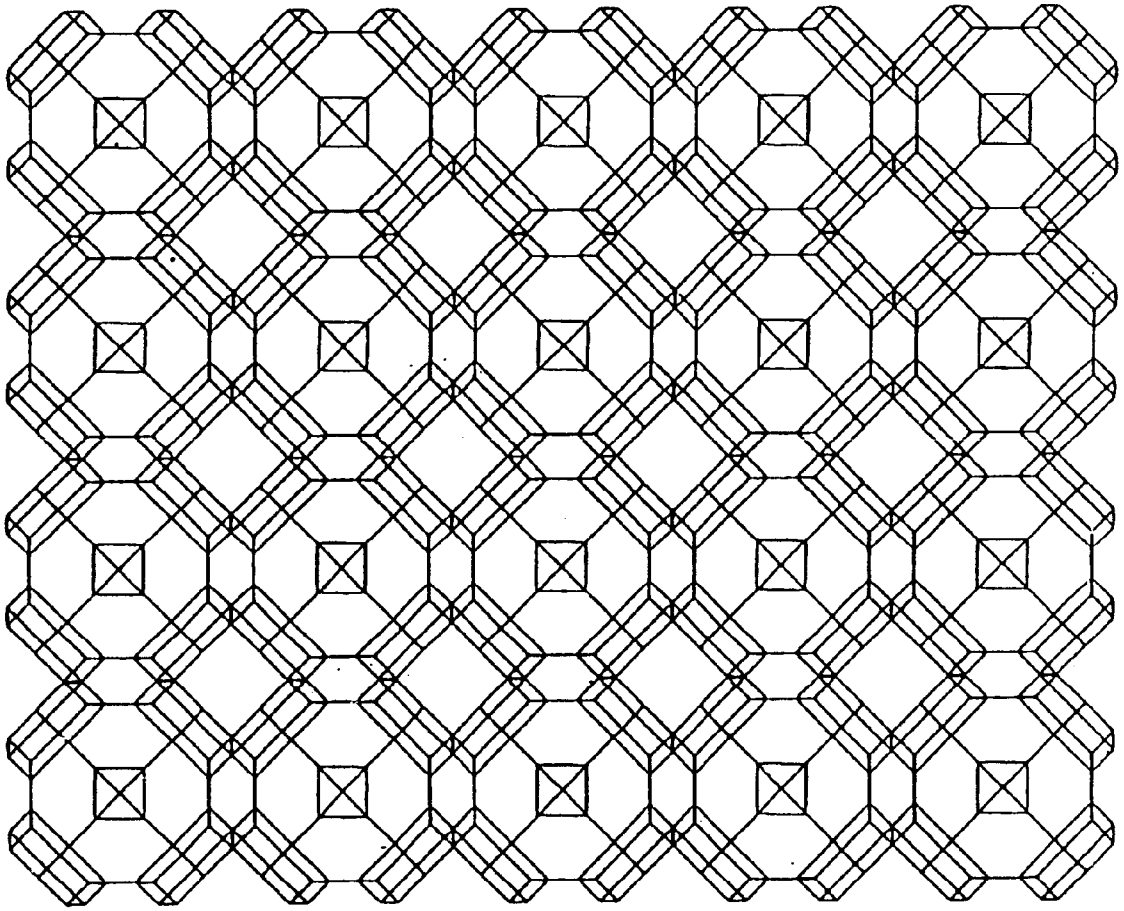
Figure 5:
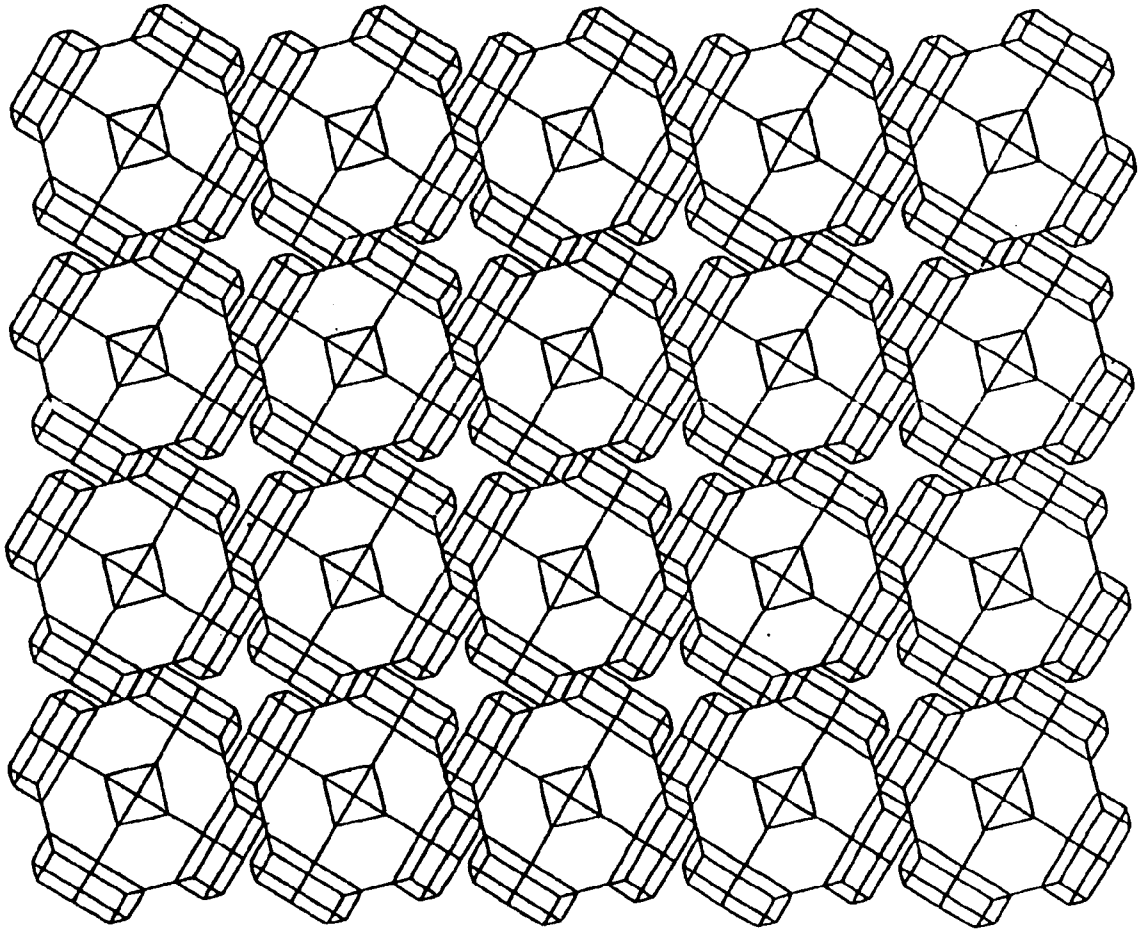

FIGS. 3 to 5 disclose an ideal arrangement of the placement type. In reality, there are limitations to construct the ideal arrangement of the placement type at the construction site. However, the actual construction should not deviate from the selected ideal arrangement of the placement type if possible.

Using the half-lock block shown in FIG. 1, the number of required blocks can be calculated from a given area of the construction site depending on the selected placement types of Type I, Type II, and Type III. The porosity can be calculated by counting a height of the top and bottom of the blocks.

Using the placement types described above, an experiment for the exposure stability can be performed to apply the actual construction. The data of exposure stability is obtained through the experiments because the coated block would be exposed to the wave during the construction.

An experimental section of model is determined by considering the parameters related to the size of the block, the expected stability, the size of the model and the source of a wave and reservoir. Table 1 shows the relationship of the above parameters based on the given experimental conditions.

| C (cm) | V (cm^3) | W (g) | $K_D$ | $H_{1/3}$, cm | $H_{max}$, cm | $D_g$, cm | $R_u$, cm | $D_s + R_u$ | $R_L$, cm |
|---|---|---|---|---|---|---|---|---|---|
| 5.40 | 33.60 | 77.29 | 3.00 | 7.62 | 15.33 | 25.13 | 18.39 | 43.52 | 18.39 |
| 5.40 | 33.60 | 77.29 | 4.00 | 8.39 | 16.87 | 27.65 | 20.24 | 47.90 | 20.24 |
| 5.40 | 33.60 | 77.29 | 5.00 | 9.04 | 18.17 | 29.79 | 21.81 | 51.60 | 21.81 |
| 5.40 | 33.60 | 77.29 | 6.00 | 9.60 | 19.31 | 31.66 | 23.17 | 54.83 | 23.17 |
| 5.40 | 33.60 | 77.29 | 7.00 | 10.11 | 20.22 | 33.33 | 24.39 | 57.72 | 24.39 |
| 5.40 | 33.60 | 77.29 | 9.00 | 10.99 | 22.10 | 36.24 | 26.53 | 62.76 | 26.53 |
| 5.40 | 33.60 | 77.29 | 10.00 | 11.39 | 22.89 | 37.53 | 27.47 | 65.01 | 27.47 |
| 5.40 | 33.60 | 77.29 | 11.00 | 11.75 | 23.63 | 38.74 | 28.36 | 67.10 | 28.36 |
| 5.40 | 33.60 | 77.29 | 12.00 | 12.10 | 24.33 | 39.88 | 29.20 | 69.08 | 29.20 |
| 5.40 | 33.60 | 77.29 | 13.00 | 12.43 | 24.99 | 40.96 | 29.98 | 70.95 | 29.98 |
| 5.40 | 33.60 | 77.29 | 14.00 | 12.74 | 25.61 | 41.99 | 30.73 | 72.72 | 30.73 |
| 5.40 | 33.60 | 77.29 | 15.00 | 13.03 | 16.21 | 42.96 | 31.45 | 74.41 | 31.45 |

Therefore, FIGS. 3 and 5 of the present invention show arrangement methods for the placement type.

The placement type of FIG. 3 (hereinafter "Type I") shows a method of half interlocking. This method of half interlocking arranges blocks to contact a pro-outside of leg 14 of one block to an aft-outside of leg 14 of a neighbor block in a first serial line, and the left-outside or right-outside of leg 14 of the blocks in a second serial line. The right-outside or left-outside of leg 14 of the blocks in the neighbor serial line are contacted by disposing each leg inside a concave area which is created by a serial line, and then coating over the blocks.

The arranged blocks of half-interlocking looks like a honeycomb. The pro- or aft-outside leg 14 of the neighbor blocks contacting each other in a serial direction are contacted perpendicular to the left or right outside legs 14 of the blocks in the second serial line, and form a zigzag arrangement. This method of placement type perfectly links each block together to be almost static.

Wherein: C is the basic scale of the half loc.

V is the volume.

W is the weight.

$K_D$ is the Hudson's stability coefficient.

$H_{1/3}$ is the significant wave height.

$H_{max}$ is the maximum wave height.

$D_s$ is the water depth of the front slope surface.

$R_u$ is the run-up height.

$D_s+R_u$ is the height of the block.

$R_L$ is the height of free board.

From each of the parameters described above, a weight of the half-loc could be calculated, and then the height of a wave corresponding to the value of the expected stability could be calculated for the design of experimental conditions. The volume of the half-loc could be calculated for the design of experimental conditions. The volume of the half-loc could be calculated from the equation 1 by using the basic scale of "C." After the volume is determined, the corresponding weight of the half-loc could be calculated.

The significant wave height $H_{1/3}$ could be calculated based on the Hudson's stability coefficient $K_D$. (For the Hudson's stability coefficient $K_D$ refer to "Laboratory Investigation of rubble mound breakwater," 1965, Proc. ACSE, vol. 85). Hudson suggests an equation for the Hudson's stability coefficient $K_D$ as shown below.

$$K_D=\gamma(H_{1/3})^3/W(S_r-1)^3\cot\theta \quad (2)$$

Wherein: W is the weight of armor block.

$\gamma$ is the specific weight of concrete in the air.

(2.657 g/cm$^3$ for granite, 2.5 g/cm$^3$ for concrete)

$S_r$ is the specific gravity of concrete against the seawater.

cot $\theta$ is the slope.

The $K_D$ value is set up in a range of 3 to 12. This range of the value is quoted from the blocks used for other purposes because there are no previous examples or data available for the middle armor block. An X-block, such as an all side slope coating material or a solid block developed by Japanese company TETRA, suggests a $K_D$ value of 10. It is hard to estimate the hydraulic stability because the rate of porosity varies depending on the placement types. For the smooth slope, the $K_D$ value is estimated to be in the range of 4 to 5 based on the $K_D$ value of 10 based on the X-block as a standard value. This invention of the half-loc is designed to use the block on a slope rate of 1:1.5. Therefore, the $K_D$ value is in the stable range for the smooth slope. From the TABLE 1, the value of $H_{1/3}$ is in the range of 9.60~13.03 cm.

An equation having a relationship between the maximum wave height $H_{max}$ and the significant wave height $H_{1/3}$ is introduced in the "Random Sea and Design of Maritime Structures" 1990, 16 section, by Yoshimi Goda. The equation of the wave height ratio is given:

$$(H_{max}/H_{1/3})_{mean}=0.706\{[In\ N_0]^{1/2}+(2[In\ N_0]^{1/2})\} \quad (3)$$

Wherein: $N_0$ is a frequency of wave and is used 1,000 waves.

The water depth of the breakwater is estimated based on the calculation of $H_{max}$ using the equation 3 in order not to break the wave. In this experiment, a possibility of breaking wave by the standing waves is considered and used the value of $D_s=H_{max}/0{,}61$ instead of using the value of $D_s=H_{max}/0{,}78$ which is shown in the McCowan's "On the Solitary Wave" (Philosophical magazine, 5$^{th}$ series, vol. 32, No. 194, PP 45–58) and related to a limitation of wave breaking of a solitary wave and a water depth.

Also, the run-up height $R_u$ is estimated in order to determine the height of free board $R_L$. The value of the run-up height $R_u$ is referenced from the Wallingford, "Hydraulic Experiment Station," 1970, "Report on Tests on Dolos Breaker in Hong Kong," and the experimental data of the run-up height for Dolos from Gunbak A. R., ("Estimation of incident and reflected waves in random wave experiments," 1977, Div. Port and Ocean Engineering, Rep. No. 12/77, Tech, Univ. of Norway, Trondheim). The maximum cycle of 2.5 sec is selected for a cycle T. The model section and the wave height are finally decided after verifying that the sum (95.91 cm) of the height of the block ($D_s+R_u$=74.41 cm) and the mound height (21.5 cm) is less than the height of a water tank (120 cm).

The water depth of the front surface $D_s$ for the experimental model of 43 cm and the front slope of 1:1.5, which is widely used, for construction of the coated slope breakwater of the tetrapod is selected. The thickness of the front slope of 2.16 cm, which corresponds to 40 percent of C—5.3 cm, and the weight ratio of the first lower layer and the second lower layer of 1:20 are selected. The thickness of the standard section of the lower layer corresponds to the thickness of the second lower layer. Based on these relationships, the model is used to simulate a natural rock having 1.4 cm thickness corresponding to the average diameter and the height of free board $R_L$ 32 cm.

The model width of the upper layer is decided by an experimental proportion because the model is not a real block, and there is no proportional simulation available. The purpose of this experiment is to determine the weight ratio and develop the middle armor block of the half-loc instead of using the natural stones of sandy rock nearby the construction site. The Froude equation is related to the weight ratio and length ratio of Wr=1r3. The estimated proportion ratio of 1:28.85 is calculated based on the 77.29g of block, 0.7m$^3$ of sandy rock and 1.855 ton of the corresponding weight. (2.65 ton/M$^3$ of specific volume-weight is used for calculation). By this time, a space of 6 m (=3 m×2 way) for two-way traffic would be provided on top of the block. Therefore, the size of the model would be 20.8 cm. The width of road 3.0 m is used according to the Standard Design of Harbor Facility.

The middle armor block of the half-loc is coated double raw in case the upper layer of the block is coated with the front slope coating material, such as T.T.P. Rear slope ratio is 1:1.5, i.e. the same as the front slope ratio. In this experiment, only the core sandy rocks are used due to the non-overtopping test.

There are two kinds of wave generators: Position Type and Absorption Type can be used in the experiments. An absorption Type of wave generator is used for this experiment.

Due to the non-overtopping test, the waves which have the significant wave height ($H_{1/3}$) and spectrum are generated corresponding to the theoretical value of the spectrum at the location of the disposed block. Each of the experiments is classified depending on the kind of waves by using the data from TABLE 1. $T_{1/3}$ is tested between the range of 1.0~2.5 sec with 0.5 sec increment for the range of 6~14 cm of wave height with 2 cm increment. The experiment is performed for total 20 kind of waves by fixing the water depth (43 cm) of the all slope surface $D_s$ and varies the values of $T_{1/3}$ and $H_{1/3}$.

A locking and displacement of the middle armor block of the half-loc is mainly continuously observed by increasing the wave height for each period of experiment. The experiment is continued by increasing the wave height for each period until the model of the breakwater or the lower portion of the sandy rock is damaged. Then, the wave height is recorded when the model is damaged.

A calculation of damage ratio is the total number of blocks divided by the accumulated number of blocks, which corresponds to the Hudson's stability coefficient $K_D$ and the significant wave height $H_{1/3}$. The equation would be:

$$D=n/N\times100(\%) \quad (4)$$

Wherein: D is a damage ratio.

n is accumulated number of blocks until the highest wave.

N is the total number of the blocks.

Figure 6:
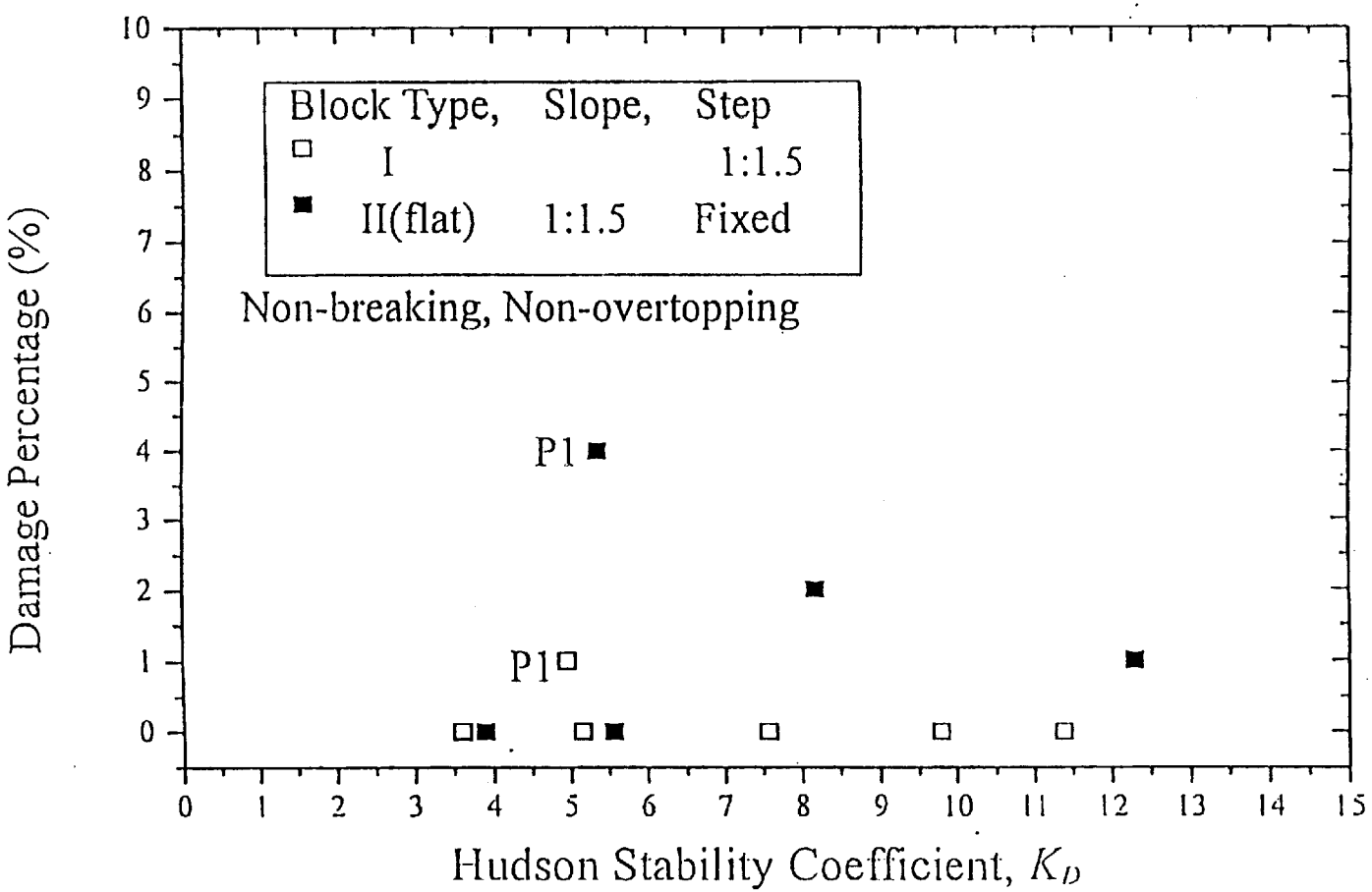
FIG. 6 shows a graph representing a relationship between the Hudson stability coefficient and the rate of damage depending on the placement of the half-loc.

FIG. 6 represents the stability obtained from the experiments for Block I and Block II. According to the test results shown in FIG. 6, the Block I is more stable than the Block II in all range of waves. Specifically, when the Block II is coated with Type I, the damage ratio would reach 4 percent. It is revealed that the Block I coated with Type I has the highest damage ratio. Except the Type I, all other models have approximately 11.0 of the $K_D$ value. Block II is easier to construct, but is less stable than Block I. Therefore, Block I has improved stability and anti-slip when all slope coated block is placed on the upper layer.

Figure 7:
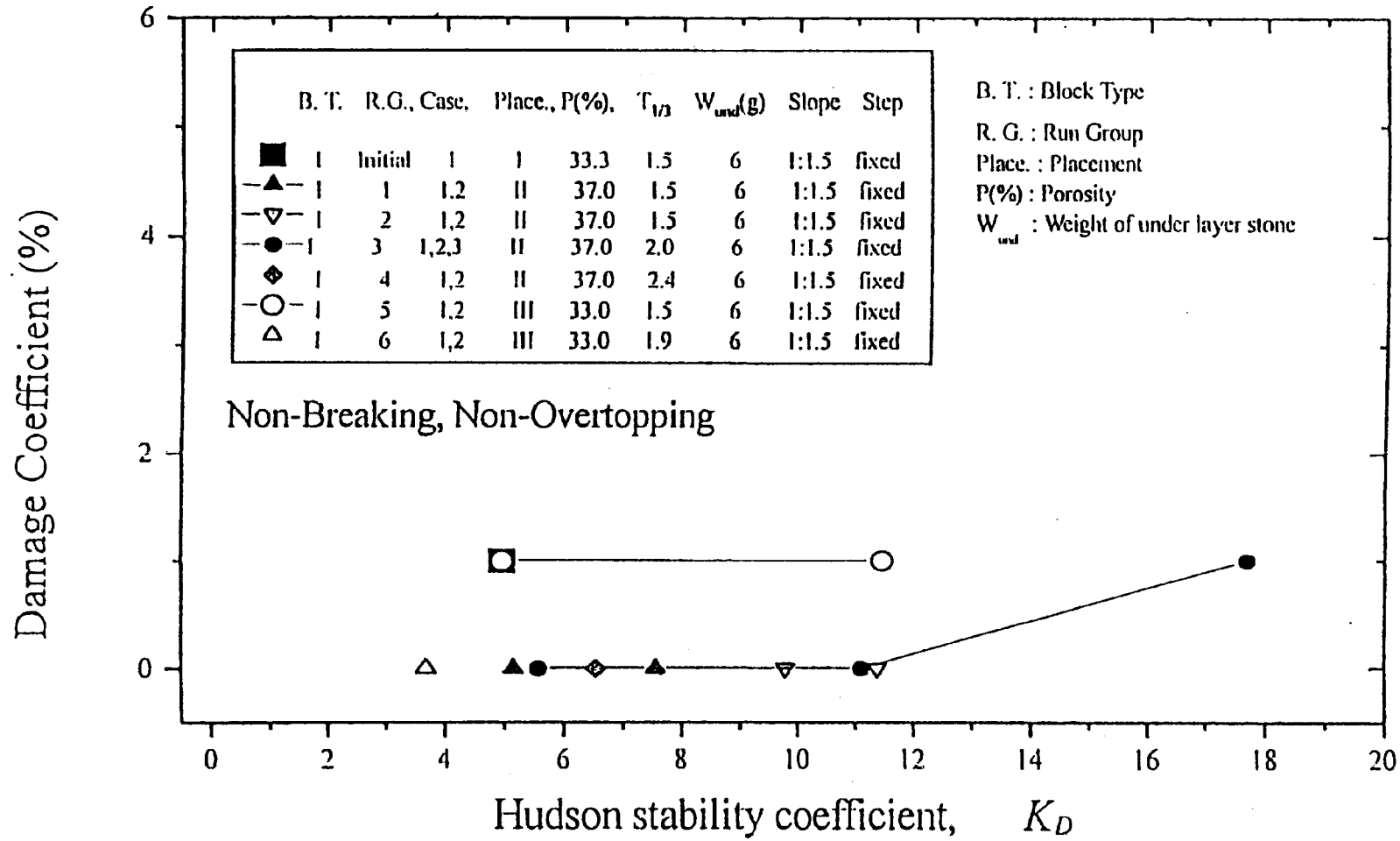
FIG. 7 shows a graph representing a relationship between the Hudson stability coefficient and the rate of damage for the placement of the half-loc shown in FIG. 3 to FIG. 5.

FIG. 7 represents the test results obtained from the experiments for Block I, Type I, Type II, and Type III. According to the test results, Type I and Type III had a damage ratio of 1 percent corresponding to 4.96 $K_D$ of the wave height. Type II received no damage until the waves reach corresponded to 11.38 $K_D$ of wave height.

For each porosity of 33.3%, 37% and 33% for Type I, Type II and Type III, the exposure stability was analyzed and compared with each other. The test results reveal that Type III is the most stable placement type.

In addition to the stability depending on the placement type of the half-loc block, another important factor is a weight calculation of the half-loc block for the lower layer coating material.

According to the conventional standard design, a weight ratio of each section is suggested. For example, a weight ratio 1:10 is used for all side slopes coating material block. In this invention, the weight ratio has determined through the experiment to establish the stability for the all side slopes coating material block.

To determine the weight ratio, the experiment is performed for the stability of all side slope coated blocks using Type II, which is the most stable placement type, and Type III, which is the least displaced type and easiest to construct. The reason why Type III is selected is that it maintains the most stability for the half-loc coated block and the lowest porosity of the placement type. If the blocks would be displaced, it will affect the stability of the all side slope coated block.

Figure 8:
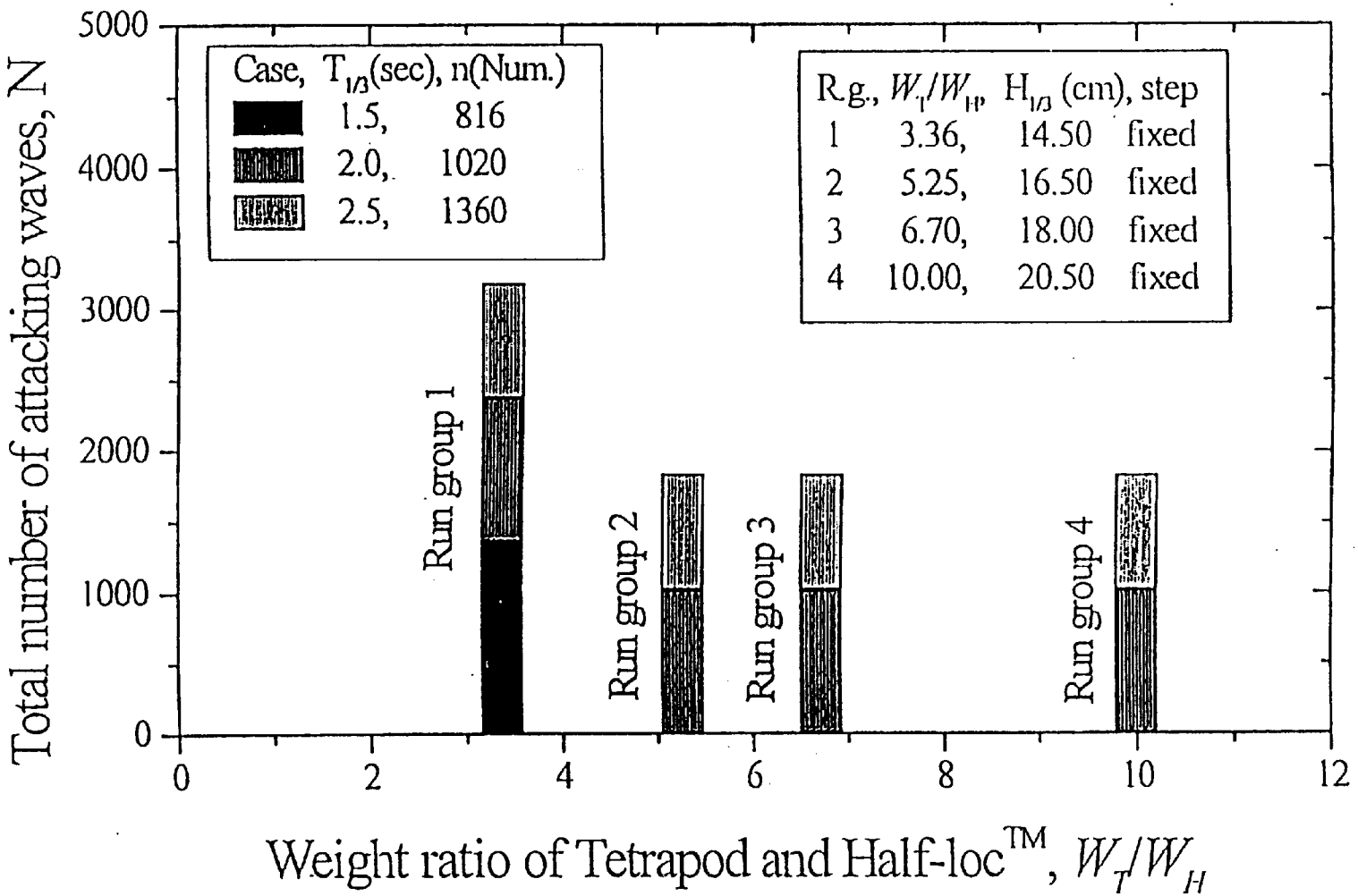
FIG. 8 shows a graph representing a relationship of the stability depending on the rate of weigh of the half-loc.

The tetrapod is used for all side slope coated block. According to this invention, the weight ratios of the half-loc coated blocks tested are 3.36, 5.25, 6.70 and 10. FIG. 8 represents the test results for the four cases of non-breaking, $K_D$=10.2 for Hudson's stability coefficient, corresponding to 150% of the biggest wave based on the normal wave.

As shown in FIG. 8, the four kinds of the weight ratios are all stable. The bar graph of FIG. 8 represents that, for example, Run Group 2, the tetrapod and the bottom portion of the half-loc coated block of this invention is impacted by 1,000 waves of 2.0 cycles, followed by the impact of 1,800 waves of 2.5 cycles. As a test result, each wave of the continuation time exceeds more than 1,000 waves. The breakwater would usually be impacted by 1,000 waves of 3~4 impacting hours during a rainstorm. Therefore, this experiment chooses the stable condition of four cases estimating at least 1,800 waves and 2.0–2.5 cycles.

The half-loc coated block of this invention, which is coated by the tetrapod using 3 to 10 times of weight, is in a stable condition.

According to the test results, the half-loc coated block of this invention could be replaced for the natural stones conventionally used in the slope type breakwater. The half-loc coated block of this invention improves the efficiency and standardization of the placement type, the lower layer and upper layer coating blocks, and the construction method.

The half-loc coated block of this invention solved problem in the conventionally slope type breakwater, calculated the stability depending on the placement type and provided a new concept of the coastal structure.

The scope and spirit of this invention is not limited to the description of this invention. It is possible for one who has a skill in the art to modify or deviate from the structure recited therein, without extending beyond the scope and spirit of this invention.

What is claimed is:

1. A middle armor block of a half-loc comprising:

a body having a shape of octagon column with a rectangle side, said body having a square-shaped perforated hole at the center;

four legs having a shape of rectangle column on four sides of said body alternatively, said legs being integrally formed to said body; and a protruding foot formed at each of an upper portion and a lower portion of said legs, each corner of said legs and said protruding foot being chamfered.

2. The middle armor block of half-loc as claimed in claim 1, wherein said legs are measured with a basic dimension of C, a thickness of said legs is 0.2 C, a width of said legs is 0.4 C, and a thickness of said body is less than 0.4 C, wherein the total volume of said block using the scale "C" for a standard dimension satisfies the equation $V\text{-}kC^3$, k being in the range of about 0.18 to about 0.3.

3. A middle armor block of a half-loc comprising:

a body portion including a hole perforating from a top surface to a bottom surface;

at least four legs projecting from each of four side surfaces of said body portion; and at least one foot formed on a bottom surface of each of said legs, wherein said body portion in combination with said legs has a substantially octagonal shape.

4. The armor block as claimed in claim 3, further comprising:

at least one foot formed on a top surface of each of said legs.

5. The armor block as claimed in claim 3, wherein each of said legs has a thickness of 0.2 C and a width of 0.4 C, and wherein said body portion has a thickness less than 0.4 C.

6. The armor block as claimed in claim 3, wherein said hole is adapted to pass water upward or downward through said body portion for dispersing an up-lifting force.

7. The armor block as claimed in claim 3, wherein said hole is substantially square.

8. The armor block as claimed in claim 3, wherein said side surfaces are substantially parallel to a central axis of said hole.

9. The armor block as claimed in claim 3, wherein a weight ratio of said half-loc to an artificial armor block is 1:3~10 when said half-loc is disposed under said artificial armor block.

10. A method of stacking a plurality of armor blocks of a half-loc, comprising the steps of:

placing a first armor block in a location to resist water flow; and interlocking a leg of a second armor block with a leg of said first armor block, wherein each of said first armor block and said second armor block comprises:

a body portion including a hole perforating from a top surface to a bottom surface;

at least four legs projecting from each of four side surfaces of said body portion; and at least one foot formed on a bottom surface of each of said legs, wherein said body portion in combination with said legs has a substantially octagonal shape.

11. The method of stacking as claimed in claim 10 further comprising the steps of:

tilting said second armor block with a certain angle; and contacting each left or right side of said legs of said first armor block to respective right or left sides of neighbor legs of said second armor block.

12. The method of stacking as claimed in claim 10, wherein said plurality of armor blocks are arranged in series rows by said interlocking step.

* * * * *